US008800526B2

(12) United States Patent
Richerson

(10) Patent No.: US 8,800,526 B2
(45) Date of Patent: Aug. 12, 2014

(54) INSTRUMENTED PISTON FOR AN INTERNAL COMBUSTION ENGINE

(71) Applicant: Caterpillar Inc., Peoria, IL (US)

(72) Inventor: Jay L. Richerson, Elmwood, IL (US)

(73) Assignee: Caterpillar, Inc., Peoria, IL (US)

( * ) Notice: Subject to any disclaimer, the term of this patent is extended or adjusted under 35 U.S.C. 154(b) by 0 days.

(21) Appl. No.: 13/724,276

(22) Filed: Dec. 21, 2012

(65) Prior Publication Data

US 2014/0174395 A1 Jun. 26, 2014

(51) Int. Cl.
*F02F 3/00* (2006.01)

(52) U.S. Cl.
USPC ..... 123/193.6

(58) Field of Classification Search
CPC ..... G01L 7/16; G01L 7/163; G01L 7/166; G01M 15/06; F02F 3/16; F02F 3/18; F02F 3/20; F02F 3/22; F02F 3/225; G01K 1/024
USPC ..... 123/193.6; 29/888.04, 888.042, 29/888.044, 888.047; 92/184; 73/114.77; 701/101, 111; 374/144; 340/870.17, 340/840.01, 840.18
See application file for complete search history.

(56) References Cited

U.S. PATENT DOCUMENTS

| | | | | |
|---|---|---|---|---|
| 5,014,658 | A * | 5/1991 | Hara et al. | 123/193.6 |
| 5,106,202 | A * | 4/1992 | Anderson et al. | 374/144 |
| 5,809,962 | A | 9/1998 | Abbott et al. | |
| 5,975,188 | A | 11/1999 | Lassow et al. | |
| 6,067,844 | A | 5/2000 | Westbrook et al. | |
| 7,102,534 | B2 * | 9/2006 | Ha | 340/870.17 |
| 7,591,235 | B2 * | 9/2009 | Lemke et al. | 123/41.35 |
| 8,079,403 | B2 | 12/2011 | Kollotzek | |
| 2006/0246701 | A1 | 11/2006 | Huang | |
| 2009/0179769 | A1 * | 7/2009 | Horler | 340/870.01 |
| 2012/0250726 | A1 * | 10/2012 | Sorkine | 374/179 |

FOREIGN PATENT DOCUMENTS

GB 1261904 A 1/1972

* cited by examiner

*Primary Examiner* — Hung Q Nguyen
(74) *Attorney, Agent, or Firm* — Baker & Hostetler

(57) ABSTRACT

A piston assembly for an internal combustion engine is provided. The piston assembly includes a piston crown including an upper surface defining a bowl region, a side portion and a lower surface, a piston skirt depending from the side portion of the piston crown, a sensor, at least partially coated by a visualization material, disposed within the piston crown at a location proximate to the bowl region, and a sensor data telemetry system coupled to the sensor. Methods for manufacturing a piston assembly for an internal combustion engine are also provided.

20 Claims, 3 Drawing Sheets

INSTRUMENTED PISTON FOR AN INTERNAL COMBUSTION ENGINE

TECHNICAL FIELD

The present disclosure relates to pistons for internal combustion engines. More particularly, the present disclosure relates to a piston that has one or more embedded sensors.

BACKGROUND

During the operation of an internal combustion engine, it is desirable to acquire temperature data at various locations within one of the pistons during different engine loading conditions. To collect these data, one or more through passages or bores are drilled into the piston from the top surface of the crown to the bottom surface of the crown or the undercrown, or, alternatively, through the sidewall into a cooling gallery or the bottom surface of the crown. Thermocouples are inserted into the through passages or bores, and the space above the thermocouple, as well as the space behind the thermocouple, is filled with heat resistant material to prevent damage to the thermocouple. Alternatively, the space above the thermocouple may be tapped to receive a metal screw.

There are many locations within the piston for which temperature data is desirable, but drilling the through passage or bore for the thermocouple is simply not possible due to various physical constraints. Furthermore, the location of the thermocouple is known only to a certain spatial precision, which may not satisfy the accuracy requirements of computer-based piston and/or engine modeling tools. When accurate thermocouple locations need to be determined, the piston is destructively sectioned after the testing is completed in order to measure the precise location of the thermocouple in relation to the crown, sidewalls and undercrown of the piston. Accordingly, computer-based piston and/or engine modeling can only be accomplished after the precise location of the thermocouples are determined through destructive means, after which further testing of that piston is no longer possible.

It is therefore desirable to accurately and non-destructively locate thermocouples and/or other sensors within a piston at any desired location, with a much higher degree of precision, than has previously been possible.

SUMMARY

One aspect of the present disclosure provides a piston assembly for a combustion engine. The piston assembly includes a piston crown including an upper surface defining a bowl region, a side portion and a lower surface, a piston skirt depending from the side portion of the piston crown, a sensor, at least partially coated by a visualization material, disposed within the piston crown at a location proximate to the bowl region, and a sensor data telemetry system coupled to the sensor.

A further aspect of the present disclosure provides a method for manufacturing a piston for an internal combustion engine. The method includes forming a mold to cast a piston crown including a top surface defining a bowl region, a side portion and a bottom surface, suspending a soluble casting core within the mold to define a sensor passage within the piston crown that extends from a portion of the mold to a location proximate to the bowl region, casting the piston, and dissolving the soluble casting core from the piston crown to form the sensor passage.

Another aspect of the present disclosure provides another method for manufacturing a piston for an internal combustion engine. The method includes forming a mold to cast a piston crown including a top surface defining a bowl region, a side portion and a bottom surface, suspending a sensor within the mold to embed the sensor within the piston head at a location proximate to the bowl region, and casting the piston.

DETAILED DESCRIPTION

Figure 1:
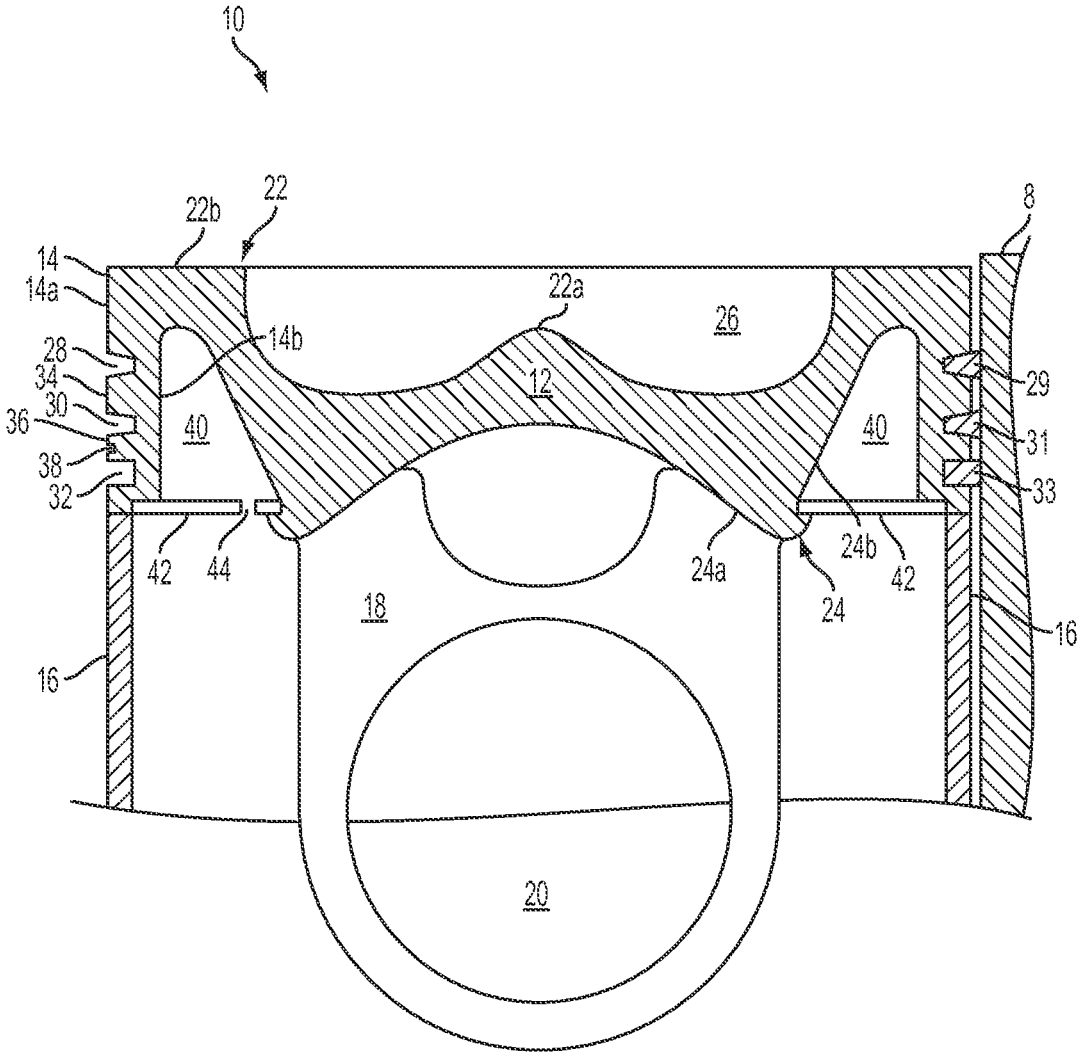
FIG. 1 presents a cross section of a portion of a piston for an internal combustion engine in accordance with the present disclosure.

FIG. 1 presents a cross section of a portion of a piston for an internal combustion engine in accordance with an embodiment of the present disclosure.

For reference purposes, a portion of combustion engine cylinder wall 8 is depicted on the right side of FIG. 1. Piston 10 includes a crown 12, a side portion 14 depending from the upper periphery of crown 12, a skirt 16, depending from the side wall 14, and a pin bosses 18 depending from the lower central region of crown 12. Alternatively, pin bosses 18 may be formed within skirt 16. Each pin boss 18 includes a pin bore 20. Crown 12 has an upper surface 22 and a lower surface 24. A combustion bowl region 26, defined by a portion 22*a* of the upper surface 22, is formed within the crown 12, while the remaining portion 22*b* of upper surface 22 is generally planar. One portion 24*a* of the lower surface 24 may be generally curved, while another portion 24*b* of the lower surface 24 may be generally straight. A cooling gallery may be formed within the crown 12, defined by the inner surface 14*b* of side wall 14, the lower surface portion 24*b* and a cooling gallery ring 42. At least one small through passage or bore 44 may be provided in cooling gallery ring 42.

The outer surface 14*a* of side wall 14 may include one or more ring grooves 28, 30, 32 which may contain one or more piston rings 29, 31, 33, respectively, as well as one or more lands 34, 36 therebetween. An accumulation groove 38 may also be provided in one of the lands, such as land 36, to capture carbon deposits. Additionally, a cooling gallery 40 may be formed within the crown 12, as defined by the inner surface 14*b* of side wall 14, the lower surface portion 24*b* of the lower surface 24 and the cooling gallery ring 44.

In one embodiment, piston 10 may be formed by casting, as is known in the art.

Figure 2:
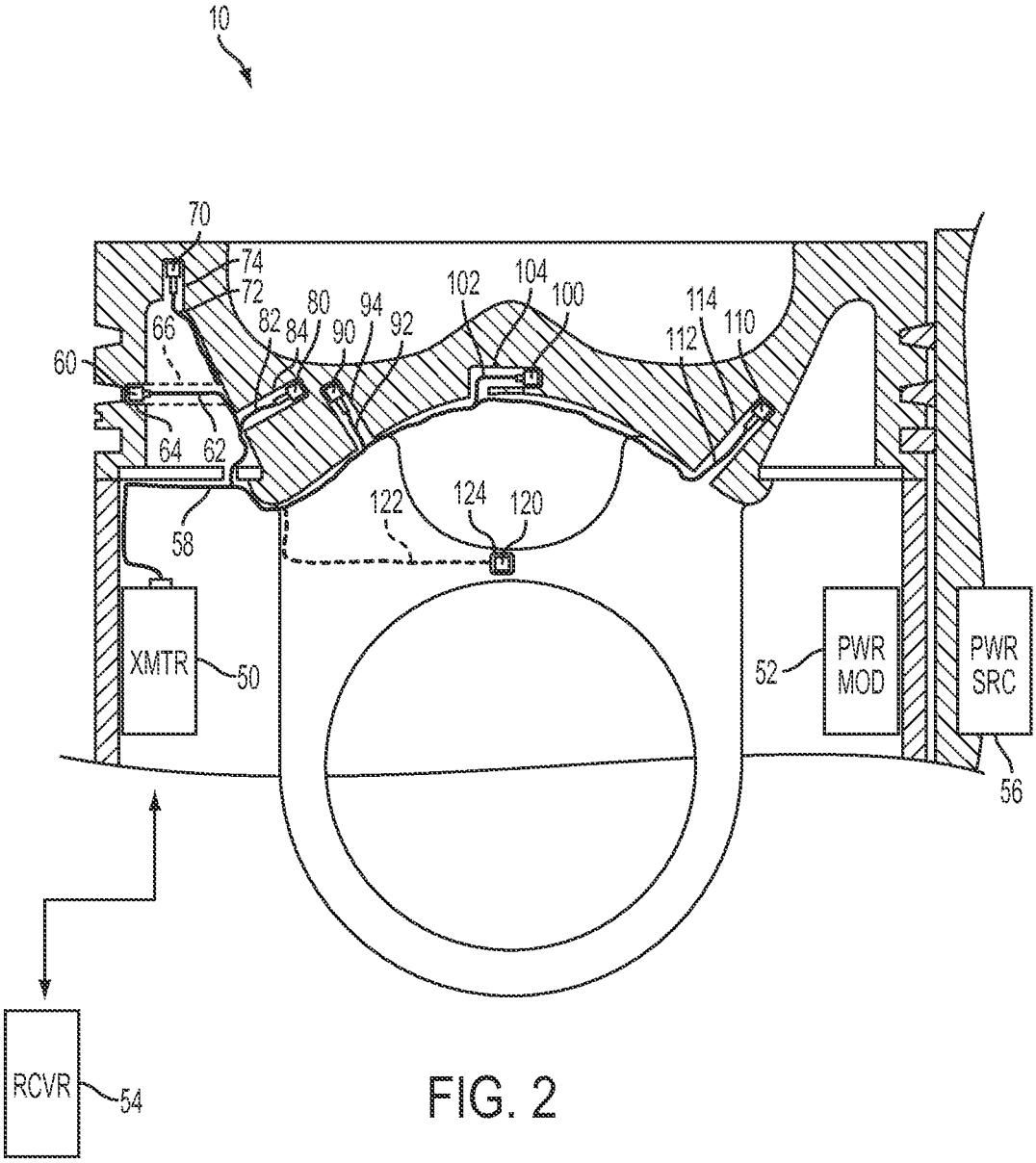
FIG. 2 illustrates a cross section of a portion of a piston for an internal combustion engine, depicting various exemplary sensors, in accordance with the present disclosure.

FIG. 2 illustrates a cross section of a portion of a piston for an internal combustion engine, depicting various exemplary sensors, in accordance with an embodiment of the present disclosure.

Piston 10 may be advantageously instrumented with various temperature sensors whose spatial location may be accurately determined using non-destructive means. The number of temperature sensors installed within piston 10 may depend upon the requirements of the piston and/or engine modeling tools, as well as the physical dimensions of piston 10. For example, 5 or less temperature sensors may be used for small pistons, such as, for example, a piston within a small (1 L) displacement diesel engine, while 40 or more temperature sensors may be used for a large piston, such as, for example, a piston within a large (200L) displacement diesel engine.

While FIG. 2 depicts a wireless telemetry system, a hardwired system including a sensor wire harness and a mechanical grasshopper-type linkage may also be used. Generally, the wireless telemetry system includes a wireless transmitter 50 electrically connected to a wireless power module 52, a receiver 54 and a power source 56. Wireless transmitter 50 and wireless power module 52 may be mounted to opposing inner surfaces of the skirt 16, while power source 56 may be mounted on an outer surface of the cylinder wall 8, crank case or, generally, on the engine block. Power source 56 inductively couples power to wireless power module 52.

As depicted in FIG. 2, various temperature sensors 60, 70, 80, 90, 100, 110, 120 are located within piston 10, each of which has a pair of wire leads 62, 72, 82, 92, 102, 112, 122 that is connected to wireless transmitter 50 through a cable harness 58. In one embodiment, the sensors are J type thermocouples; other types of temperature sensors may also be used, such as, for example, a thermistor, a resistive temperature detector (RTD), etc., as well as other types of sensors, generally, alone or in combination with temperature sensors, such as, for example, a strain gauge, an accelerometer, a pressure transducer, a proximity probe, etc. In this embodiment, a passage or bore is formed for each temperature sensor during the piston casting process, and each temperature sensor is then installed within a specific passage. The temperature sensor wire leads 62, 72, 82, 92, 102, 112, 122 extend out of each respective passage 64, 74, 84, 94, 104, 114, 124 and are coupled to the cable harness 58. Heat resistant material is provided within each passage to seal the passage and prevent the temperature sensor from overheating.

In one embodiment, the passages 64, 74, 84, 94, 104, 114, 124 may be formed using respective soluble cores that are attached to, and extend from, the mold. The piston mold is formed, which includes the piston crown and the piston skirt. Alternatively, the piston crown may be cast separately from the piston skirt, and subsequently mated. Soluble casting cores are then suspended within the mold to define passages 64, 74, 84, 94, 104, 114, 124. After the piston 10 is cast and the mold removed, the soluble cores are dissolved, leaving the passages 64, 74, 84, 94, 104, 114, 124 within piston 10. Generally linear passages, such as passages 64, 74, 84, 94, 114 may be formed, as well as non-linear passages, such as passage 104 which includes one or more changes in direction, such as a 90° bend, or passages that intersect the cross-sectional plane, such as passage 124, which runs generally perpendicular to the cross-sectional plane depicted in FIG. 2.

Various exemplary temperature sensor locations are illustrated in FIG. 2. While these locations are depicted in the same cross-sectional plane, additional temperature sensors may be mounted within the piston at other locations, generally, as well as other cross-sectional planes. For example, defining the cross-sectional plane depicted in FIG. 2 as the 0° plane, one or more additional temperature sensors may be located in the 30°, 60°, 90°, 120° and 150° cross-sectional planes. Both symmetrical and non-symmetrical distributions are contemplated by the present disclosure, which may be driven by piston and cylinder design considerations, such as the location of intake and exhaust valves, the location of cooling oil impingement points on the undercrown, etc.

Temperature sensor 60 is located within the side wall 14 proximate to ring groove 30. Passage 64 extends horizontally through inner surface 14*b* to cooling gallery 40, and may be relatively short in length due to the thickness of the side wall 14 at this location. A tube 66 may extend from the inner surface 14*b* of side wall 14 to the lower surface portion 24*b* to protect wire leads 62. The end of passage 64, and the head of temperature sensor 60, may be about 1 mm to 5 mm from the inner wall of ring groove 30.

Temperature sensor 70 is located within the upper portion of crown 12 proximate to planar surface 22*b*. Passage 74 extends vertically through lower surface portion 24*b* to cooling gallery 40, and may be of moderate length due to the thickness of the crown 12 at this location. The end of passageway 74, and the head of temperature sensor 70, may be about 1 mm to 5 mm from the planar surface 22*b*.

Temperature sensor 80 is located within the crown 12 proximate to the upper surface portion 22*a* defining the combustion bowl region 26. Passage 84 extends at a downward angle through lower surface portion 24*b* to cooling gallery 40, and may be of moderate length due to the thickness of the crown 12 at this location. The end of passage 84, and the head of temperature sensor 80, may be about 1 mm to 5 mm from the upper surface portion 22*a*.

Temperature sensor 90 is similarly located within the crown 12 proximate to the upper surface portion 22*a* defining the combustion bowl region 26. Passage 94 extends at a downward angle through the curved lower surface portion 22*b*, and may be of moderate length due to the thickness of the crown 12 at this location. The end of passage 94, and the head of temperature sensor 90, may be about 1 mm to 5 mm from the upper surface portion 22*a*.

Temperature sensor 100 is located within the crown 12 proximate to the lower surface portion 24*a* or the undercrown. Passage 104 extends horizontally and then vertically through the lower surface portion 24*a*, and may be of moderate length due to the thickness of the crown 12 at this location. The end of passage 104, and the head of temperature sensor 100, may be about 1 mm to 5 mm from the lower surface portion 24*a*.

Temperature sensor 110 is located within the crown 12 proximate to the lower surface portion 24*b* defining the cooling gallery 40. Passage 114 extends at a downward angle through lower surface portion 24*a*, and may be of moderate length due to the thickness of the crown 12 at this location. The end of passage 114, and the head of temperature sensor 110, may be about 1 mm to 5 mm from the lower surface portion 24*b*.

Temperature sensor 120 is located within one of the pin bosses 18, and is mounted perpendicularly to the cross-sectional plane. Passage 124 extends at through the outer surface of the pin boss 18, and may be of short length due to the thickness of the crown 12 at this location. The end of passage 124, and the head of temperature sensor 120, may be about 1 mm to 5 mm from the opposing surface of the pin boss 18. The wire leads 122 run along the back side of pin boss 18.

While exemplary distances from the head of the sensors to the surfaces of interest are provided above, larger or even smaller distances are also contemplated by the present disclosure.

Figure 3:
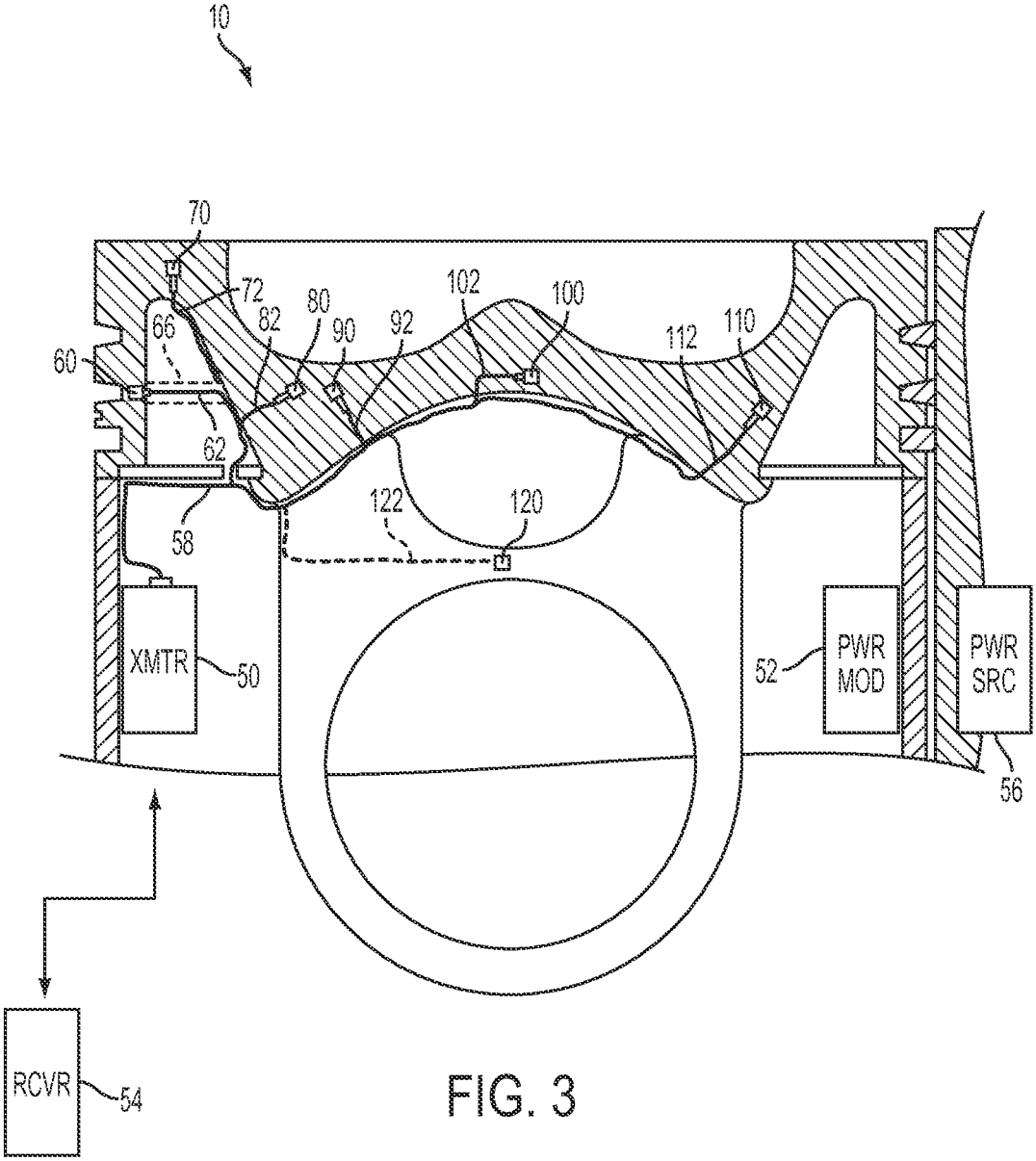
FIG. 3 illustrates a cross section of a portion of a piston for an internal combustion engine, depicting various exemplary sensors, with the present disclosure.

FIG. 3 illustrates a cross section of a portion of a piston for an internal combustion engine, depicting various exemplary sensors, in accordance with another embodiment of the present disclosure.

As depicted in FIG. 3, temperature sensors 60, 70, 80, 90, 100, 110, 120 are located within piston 10, each of which has a pair of wire leads 62, 72, 82, 92, 102, 112, 122 that is connected to wireless transmitter 50 through a cable harness 58. In this embodiment, the temperature sensors are directly cast into piston 10 during the piston casting process. The temperature sensor wire leads 62, 72, 82, 92, 102, 112, 122 extend out of piston 10 at various locations, and are then coupled to the cable harness 58. In order to orient the temperature sensors properly during the casting process, rigid wire leads may be used to extend the temperature sensors from the mold surface into the piston volume. Alternatively, metal inserts, rings, etc. may also be used to suspend the temperature sensors within the mold at their proper locations.

INDUSTRIAL APPLICABILITY

In order to accurately locate the sensors within piston 10, a portion of each sensor is at least partially coated with a visualizing material, such as silver, and the piston is imaged using a high resolution imaging device, such as, for example, an X-ray imaging device, etc. The location of each sensor is resolved in three dimensions to very high accuracies, such as, for example, from 0.1 to 0.001 mm. For example, for a thermocouple having a pair of conductors coupled at a junction, the junction is at least partially coated with silver. The X-ray image obtained by a CT scanner, for example, allows post-image processing software to calculate the location of the thermocouple in three dimensions relative to a piston-based coordinate system. For example, North Star Imaging, Inc. has developed X-ray imaging systems and services in these areas.

Advantageously, the piston may be imaged prior to installation within the internal combustion engine, so that accurate three dimensional sensor locations, as well as real time sensor data, may be provided to piston and/or engine modeling or performance software during engine operation.

The many features and advantages of the disclosure are apparent from the detailed specification, and, thus, it is intended by the appended claims to cover all such features and advantages of the disclosure which fall within the true spirit and scope thereof. Further, since numerous modifications and variations will readily occur to those skilled in the art, it is not desired to limit the disclosure to the exact construction and operation illustrated and described, and, accordingly, all suitable modifications and equivalents may be resorted to that fall within the scope of the disclosure.

What is claimed is:

1. A piston assembly for an internal combustion engine, comprising:

a piston crown including an upper surface defining a bowl region, a side portion and a lower surface;

a piston skirt depending from the side portion of the piston crown;

a sensor, at least partially coated by a visualization material, disposed within the piston crown at a location proximate to the bowl region; and a sensor data telemetry system coupled to the sensor, wherein the piston crown is structured and configured such that the piston crown comprises at least one of: a passage formed during a piston casting process and the sensor is arranged in the passage, the passage extending toward the lower surface of the piston crown; and the sensor arranged and structurally embedded within material of the piston crown during the piston casting process.

2. The piston assembly according to claim 1, wherein the visualization material is silver.

3. The piston assembly according to claim 1, wherein the sensor location is about 1 mm to 5 mm from the upper surface of the piston crown.

4. The piston assembly according to claim 1, wherein the sensor is a thermocouple having a pair of conductors connected at a junction, and wherein the conductors are coupled to the sensor data telemetry system and the junction is at least partially coated by silver.

5. The piston assembly according to claim 1, wherein the sensor data telemetry system includes a wireless transmitter coupled to the sensor, and a power source coupled to the wireless transmitter.

6. The piston assembly according to claim 1, further comprising an additional sensor, at least partially coated by a visualization material, disposed within the piston crown at a location proximate to the lower surface, and wherein the piston crown is structured and configured such that the additional sensor is disposed within a passage, formed during a piston casting process, that extends from the additional sensor location to the volume enclosed by the skirt, the passage including at least one change in direction.

7. The piston assembly according to claim 6, wherein the sensor location is about 1 mm to 5 mm from the lower surface of the piston crown.

8. The piston assembly according to claim 1, further comprising an additional sensor, at least partially coated by a visualization material, disposed within the piston crown at a location proximate to a cooling gallery, and wherein the piston crown is structured and configured such that the additional sensor is disposed within a passage, formed during a piston casting process, that extends from the additional sensor location to the lower surface of the piston crown.

9. The piston assembly according to claim 8, wherein the additional sensor location is about 1 mm to 5 mm from a portion of the lower surface of the piston crown defining the cooling gallery.

10. The piston assembly according to claim 1, further comprising an additional sensor, at least partially coated by a visualization material, disposed within the side portion of the piston crown at a location proximate to a ring groove, and wherein the piston crown is structured and configured such that the additional sensor is disposed within a passage, formed during a piston casting process, that extends from the additional sensor location to the ring groove.

11. The piston assembly according to claim 1, wherein the sensor is a thermocouple, a thermistor, a resistive temperature detector, a strain gauge, an accelerometer, a pressure transducer, or a proximity probe.

12. The piston assembly according to claim 1, wherein the visualization material is structured and arranged to be detected by an imaging device.

13. The piston assembly according to claim 1, wherein the sensor data telemetry system comprises a wireless power module arranged in the piston and a power source arranged in a cylinder wall that inductively couples power to the wireless power module.

14. The piston assembly according to claim 1, wherein the sensor data telemetry system comprises a wireless power module arranged in the piston and a power source arranged in a cylinder wall, the wireless power module and the power source being configured to inductively couple and inductively provide power from the power source to the wireless power module.

15. A piston assembly for an internal combustion engine, comprising:

a piston crown including an upper surface defining a bowl region, a side portion and a lower surface;

a piston skirt depending from the side portion of the piston crown;

a sensor, at least partially coated by a visualization material, disposed within the piston crown at a location proximate to the bowl region; and a sensor data telemetry system coupled to the sensor, wherein the sensor data telemetry system comprises a wireless sensor data telemetry system, a wireless power module arranged in the piston, and a power source arranged in a cylinder wall that inductively couples power to the wireless power module.

16. The piston assembly according to claim 15, wherein the piston crown is structured and configured such that the sensor is disposed within a passage, formed during a piston casting process, that extends from the sensor location to the lower surface of the piston crown.

17. The piston assembly according to claim 15, wherein a cooling gallery is defined by an inner surface of the side portion of the piston crown, a portion of the lower surface of the piston crown and a cooling gallery ring, and the piston crown is structured and configured such that the sensor is disposed within a passage, formed during a piston casting process, that extends from the sensor location to the cooling gallery ring.

18. The piston assembly according to claim 15, wherein the piston crown is structured and configured such that the sensor is embedded within the piston crown during a piston casting process.

19. The piston assembly according to claim 15, wherein the piston crown is structured and configured such that the sensor is disposed within a passage, formed by a machining process applied to the piston crown, that extends from the lower surface of the piston crown to the sensor location.

20. The piston assembly according to claim 15, wherein the visualization material is structured and arranged to be detected by an imaging device.

* * * * *